US007080426B2

(12) United States Patent
Roychowdhury

(10) Patent No.: US 7,080,426 B2
(45) Date of Patent: Jul. 25, 2006

(54) CARPET STAIR ROD SET

(75) Inventor: Ron Roychowdhury, Cherry Hill, NJ (US)

(73) Assignee: Brass Elegans, Inc., Cherry Hill, NJ (US)

( * ) Notice: Subject to any disclaimer, the term of this patent is extended or adjusted under 35 U.S.C. 154(b) by 11 days.

(21) Appl. No.: 10/844,627

(22) Filed: May 13, 2004

(65) Prior Publication Data

US 2005/0251955 A1 Nov. 17, 2005

(51) Int. Cl.
*A47G 27/04* (2006.01)

(52) U.S. Cl. ..... 16/10; 16/12

(58) Field of Classification Search ..... 16/10, 16/12, 15, 16, 17.1, 17, DIG. 3; 248/211, 248/201, 258, 251; 49/42, 128, 145, 461; 24/547, 572.1

See application file for complete search history.

(56) References Cited

U.S. PATENT DOCUMENTS 869,492 A * 10/1907 Joyner ..... 16/15
D342,437 S * 12/1993 Prezner ..... D8/380
5,960,516 A * 10/1999 Zoroufy et al. ..... 16/12
6,338,179 B1 * 1/2002 Blackstone ..... 16/12
6,839,936 B1 * 1/2005 Kaufman ..... 16/12
D507,478 S * 7/2005 Blackstone ..... D8/378
2004/0231097 A1 * 11/2004 Zoroufy et al. ..... 16/12

* cited by examiner

*Primary Examiner*—Robert J. Sandy
*Assistant Examiner*—Mark T. Vogelbacker
(74) *Attorney, Agent, or Firm*—Caesar, Rivise, Bernstein, Cohen & Pokotilow, Ltd.

(57) ABSTRACT

A bracket for retaining a stair rod includes a first bracket portion defining a first bracket plane for affixing the first bracket portion to a stair and a second bracket portion rotatably coupled to the first bracket portion for rotation between bracket open and bracket closed positions and defining a second bracket plane wherein the first and second bracket planes are coplanar only when the bracket is in the bracket closed position. Friction between a surface of the first bracket portion and a surface of the second bracket portion can provides a friction fit between the first and second bracket portions and maintain the bracket in the bracket closed position. An axis is defined by an intersection of the first and second bracket planes wherein the friction fit is provided by friction between the surfaces of the first and second bracket portions in the vicinity of the axis.

16 Claims, 5 Drawing Sheets

CARPET STAIR ROD SET

FIELD OF THE INVENTION

The present invention relates to carpeting and in particular to fixing a carpet to a surface.

BACKGROUND OF THE INVENTION

It is often desirable, for both functional and aesthetic reasons, to lay a carpet runner across one or more stair steps in a staircase. On the functional side carpeting protects the surface of the stair step, such as the wood surfaces typically found in private residences, from the wear and tear associated with normal foot traffic. Additionally, carpeting provides for a softer, more secure footing for those walking up or down the staircase. With regard to aesthetics, carpets come in a multitude of colors, patterns and materials, providing a wide range of decorating options. In any case, carpet runners can be removed and replaced should they become worn or if there is a change in decorating taste.

When a carpet runner is used on a staircase, stair rods are often used to hold the runner in place. The typical stair rod comprises a rod longer than the width of the carpet runner which it is securing. Once the carpet runner is laid across a stair step, the rod is placed at the bend between the horizontal plane of the stair step and the vertical plane extending upward to the next stair in the staircase. Brackets at the end of the rod hold the rod and the underlying carpet firmly in place. Stair rods are not only important for aesthetic reasons, such as keeping the runner centered along the stair step and providing additional ornamentation, but more importantly for safety reasons. Slippage of the carpet runner under the foot of a person walking thereon can cause potentially dangerous slips and falls, as well as twisted ankles and other injuries. Thus, stair rod brackets must hold the rod securely in place with minimal slippage either along the longitudinal axis of the rod or at an angle thereto.

U.S. Pat. No. 6,338,179 (Blackstone) describes a carpet rod bracket for retaining a stair rod and includes a first portion for affixing to a stair, including means for securing a finial thereto and a seat for receiving an end of the corresponding stair rod. A second portion is rotatably coupled to the first portion and includes means for retaining the end of corresponding stair rod in the seat of the first portion of a bracket. Means are also provided for holding the first and second portions of the bracket in engagement.

U.S. Patent Application Publication 2003/0097729 (Kaufman) describes a latching stair rod assembly. A mounting base component and an upper bracket component comprise the stair rod bracket. The mounting base component is secured to the tread in any suitable manner and it includes an aperture or an open, elongated channel. The upper bracket component conforms to the shape of the mounting base component, so that, when they are mounted together, they define a single, integral bracket. Extending out from the upper bracket component is a latch that latchably engages into the opening or channel of the mounting base. A stair rod can be easily removed or installed by sliding the upper bracket to disengage it and then by lifting it away from the mounting base.

U.S. Pat. No. 5,960,516 (Zoroufy et al.) discloses a stair rod and bracket system wherein the rod mates with a pair of slidably interconnecting brackets at each end. An inner bracket is fastened to the horizontal and vertical surfaces of the stair, while an outer bracket slides over the first bracket. A finial extends through the wall of the outer bracket and an end-stop of the inner bracket to engage a tapped (threaded) apertural in the end of the rod. This system is secure, but it is complicated to assemble or disassemble should it be necessary to remove the rod for carpet cleaning or replacement.

Another type stair rod bracket system is disclosed in U.S. Pat. No. 342,437 (Prezner) and U.S. Pat. No. 869,492 (Joyner). This system uses hinged clamps which are secured to the stair and which open to receive the stair rod. Once the rod is in place, the clamp is fastened closed around the rod. The rod extends completely though the clamp and is thus susceptible to lateral slippage. Moreover, the finial must be affixed to the rod itself, when used.

Certain disadvantages related to prior stair rod sets are addressed and improved upon by the present invention. Optimally, a stair rod system should include as few separate parts to assemble as possible. The more parts required, the more parts may be misplaced or destroyed in the process of assembling and disassembling the stair rod system. Moreover, more parts make polishing more difficult. Additionally, it is more costly and complex to manufacture and assemble extra parts.

SUMMARY OF THE INVENTION

A bracket for retaining a stair rod includes a first bracket portion defining a first bracket plane for affixing the first bracket portion to a stair and a second bracket portion rotatably coupled to the first bracket portion for rotation of the first and second bracket portions between bracket open and bracket closed positions and defining a second bracket plane wherein the first and second bracket planes are coplanar only when the bracket is in the bracket closed position. The bracket can maintain the bracket closed position independently of any releasably securing means. Friction between a surface of the first bracket portion and a surface of the second bracket portion provides a friction fit between the first and second bracket portions and maintain the bracket in the bracket closed position. An axis is defined by an intersection of the first and second bracket planes wherein the friction fit is provided by friction between the surfaces of the first and second bracket portions in the vicinity of the axis. A press fit hinge can be provided in the vicinity of the axis. The bracket has a mating region including a mating projection disposed on one of the first and second bracket portions and a mating projection receiving region disposed on the other of the first and second bracket portions for matably receiving the mating projection within the mating projection receiving region. Friction between the surfaces of the mating projection and the mating projection receiving region can provide a friction fit between the first and second bracket portions for maintaining the bracket in the bracket closed position. The stair rod is received and secured in a region defined by the first and second bracket portions when the bracket is in the bracket closed position. A bracket angle between the first and second bracket planes increases in magnitude as the second bracket portion rotates from the bracket closed position to the bracket open position.

The bracket for retaining a stair rod further includes a first bracket portion for affixing the first bracket potion to a stair and a second bracket portion rotatably coupled to the first bracket portion wherein a bracket mating region includes a mating projection disposed on one of the first and second bracket portions. A mating projection receiving region is disposed on the other of the first and second bracket portions for matably receiving and surroundingly retaining the mating projection within the mating projection receiving region.

The bracket can maintain the bracket closed position independently of any releasably securing means. Friction between a surface of the first bracket portion and a surface of the second bracket portion can provides a friction fit between the first and second bracket portions and maintain the bracket in the bracket closed position. An axis is defined by an intersection of the first and second bracket planes wherein the friction fit is provided by friction between the surfaces of the first and second bracket portions in the vicinity of the axis. A press fit hinge can be provided in the vicinity of the axis. The bracket has a mating region including a mating projection disposed on one of the first and second bracket portions and a mating projection receiving region disposed on the other of the first and second bracket portions for matably receiving the mating projection within the mating projection receiving region. Friction between the surfaces of the mating projection and the mating projection receiving region can provide a friction fit between the first and second bracket portions for maintaining the bracket in the bracket closed position. The stair rod is received and secured in a region defined by the first and second bracket portions when the bracket is in the bracket closed position. A bracket angle between the first and second bracket planes increases in magnitude as the second bracket portion rotates from the bracket closed position to the bracket open position.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

The principles of the present invention and their advantages are best understood by referring to the illustrated embodiment depicted in FIGS. 1–7 of the drawings, in which like numbers designate like parts.

Figure 1:
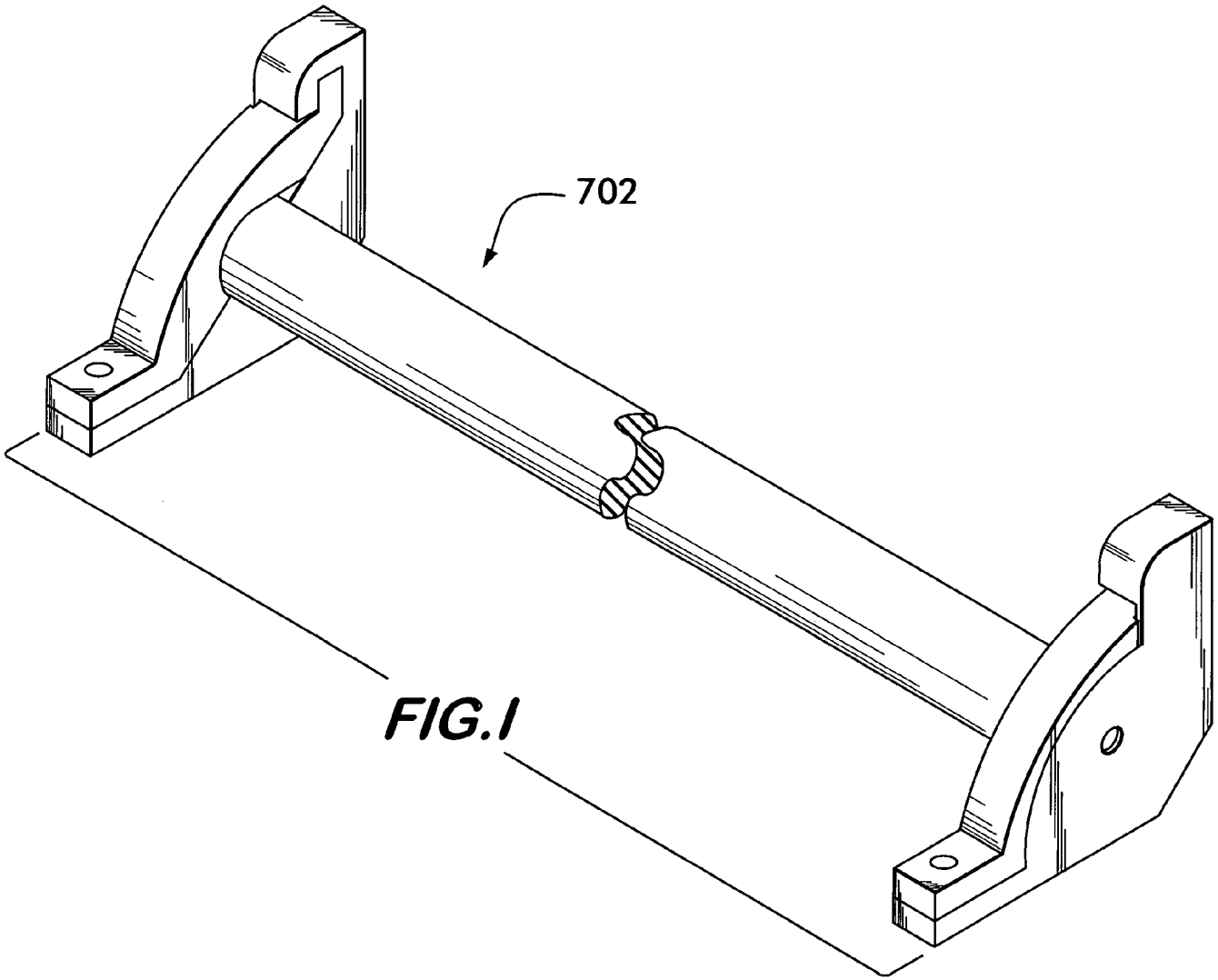
FIG. 1 is a fully assembled stair rod set including two stair rod brackets, into which a stair rod is securely inserted.

Referring now to FIG. 1, there is shown a fully assembled stair rod set 702 including two stair rod brackets 700*a,b*, into which a stair rod 501 is securely inserted.

Figure 2:
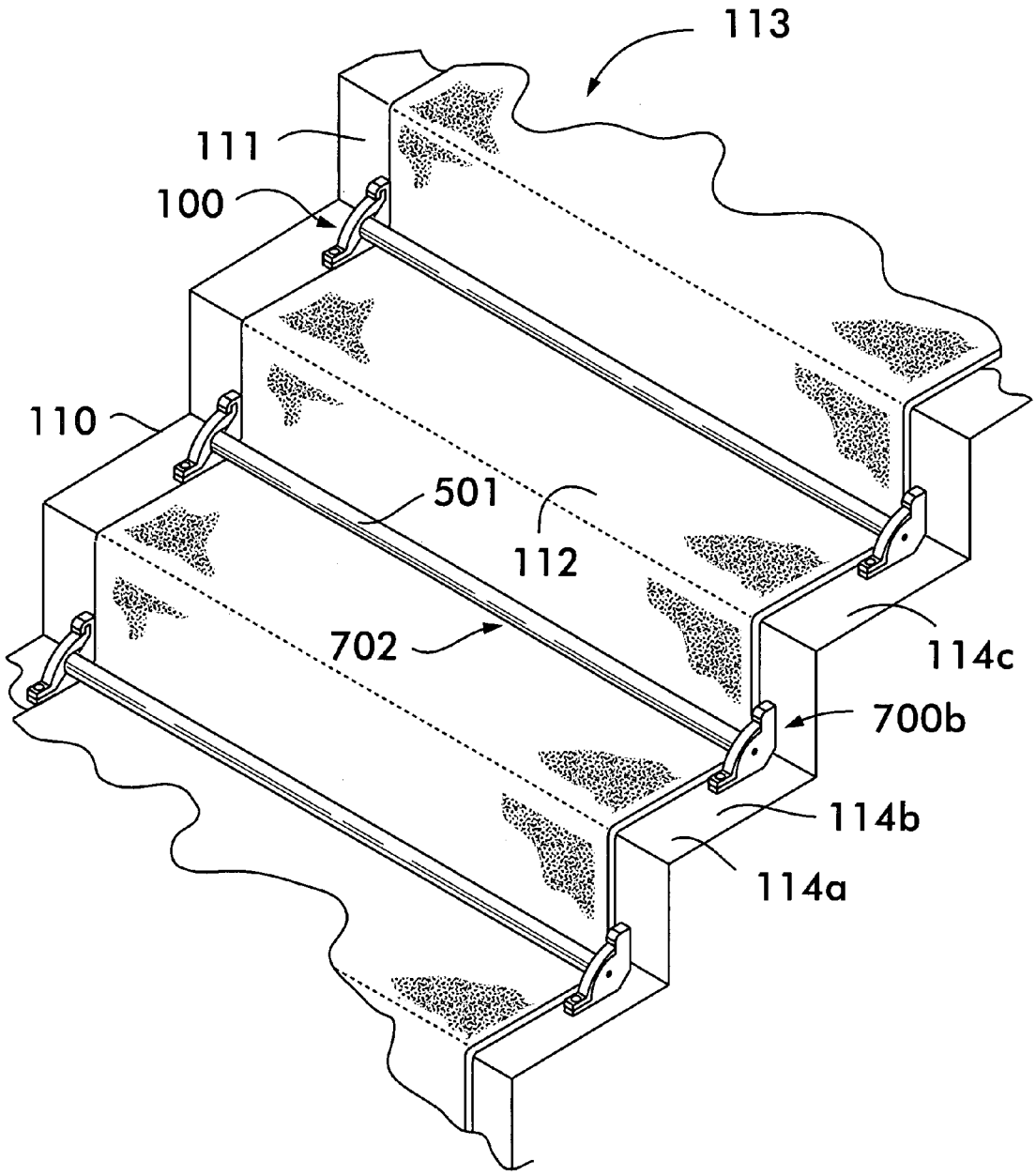
FIG. 2 is a diagram illustrating a number of stair rod assemblies according to the inventive concepts as used to secure a carpet runner to a corresponding set of stair steps.

FIG. 2 is a diagram of a portion of a staircase 113 including three stair steps 114*a–c*. Each stair step 114*a–c* includes a horizontal surface 110 spaced from the horizontal surfaces 110 of the adjacent stair step by a vertical surface 111. In this example, a carpet runner 112 is disposed along a length of staircase 113 and generally centered between the lateral boundaries of stair steps 114*a–c*. For illustrative purposes, the carpet runner 112 is a generic carpet runner of solid color widely available from most carpet retailers.

At the intersection of the horizontal surface 110 and the vertical surface 111 of each stair step of staircase 113 is a fully assembled stair rod set 702 in accordance with the inventive concepts. Each fully assembled stair rod set 702 includes a stair rod 501 held securely against the surface of carpet runner 112 by a set of stair rod brackets 700*a,b*, disposed at the opposing ends of stair rod 501. Stair rod brackets 700*a,b* are fastened to the surfaces 110, 111 of the corresponding stair step 114 by screws or any other fasteners known in the art.

Figure 3:
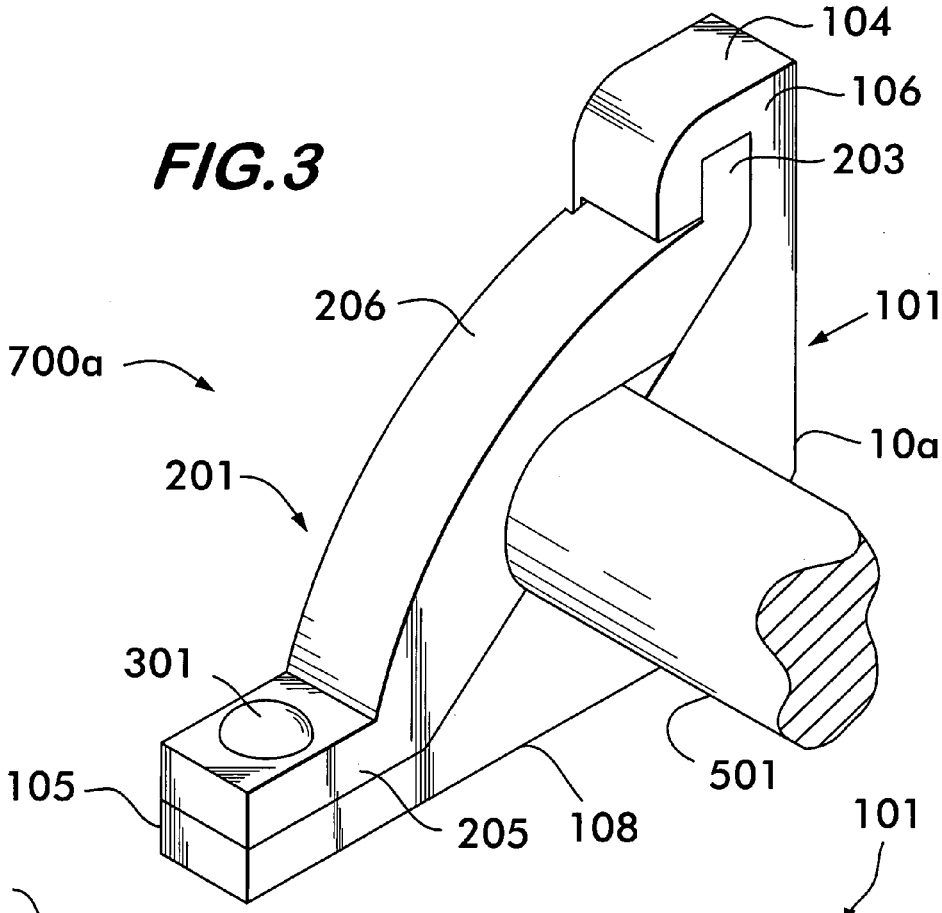
FIG. 3 is a perspective view of the stair rod bracket in a closed position with the end portion of a stair rod inserted into the bracket.

FIG. 3 is a perspective view of the stair rod bracket 700*a* in a closed position with the end portion of a stair rod 501 received in the bracket 700*a*. The bracket 700*a* comprises a lower bracket portion 101 to which the upper bracket portion 201 is rotatably coupled by means of a press fit hinge screw 301. The bottom surface 108 of the lower bracket portion 101 is adapted to be placed in contact with a horizontal surface 110 of a stair 114*a–c* as shown in FIG. 2. A vertical surface 109 of the lower bracket portion 101 is meant to be placed in contact with a vertical surface 111 of a stair step 114*a–c*, as also shown in FIG. 1. The outer curved surface 206 of the upper bracket portion 201 may optionally feature an aesthetic design.

Figure 4A:
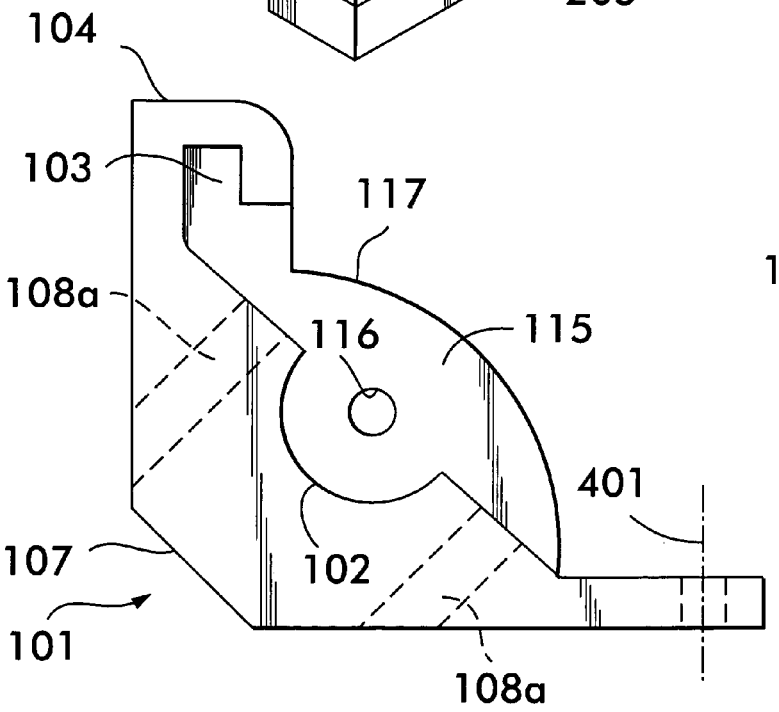
FIGS. 4A and 4B depict, respectively, side and front views of the lower bracket portion of the stair rod bracket of FIG. 1.
Figure 4B:
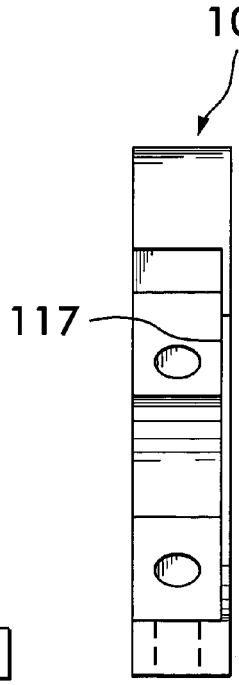
Figure 5A:
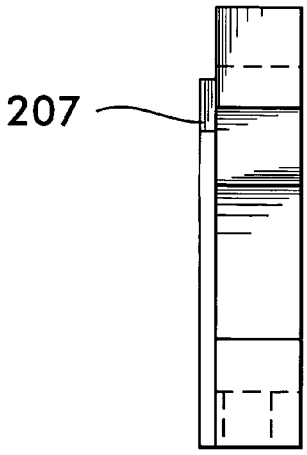
FIGS. 5A and 5B depict, respectively, front and side views of the upper bracket portion of the stair rod bracket of FIG. 1.
Figure 5B:
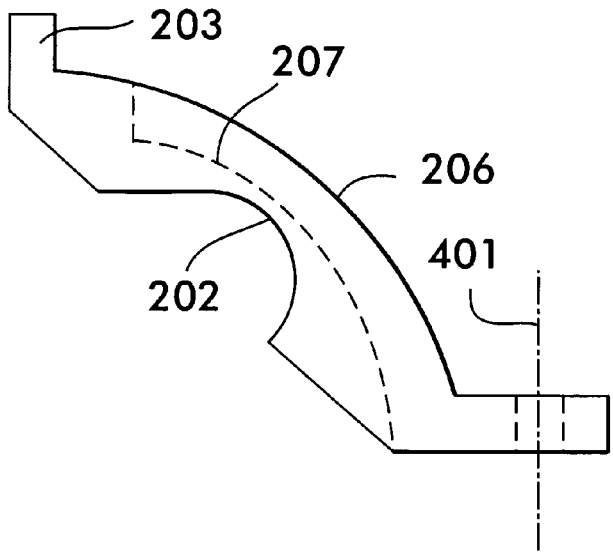

FIGS. 4A and 4B depict, respectively, side and front views of the lower bracket portion 101. FIGS. 5A and 5B depict, respectively, front and side views of the upper bracket portion 201. When an assembled bracket 700*a,b* is in closed position, the lip 207 of the upper bracket portion 201 receives the upper surface 117 of the rod stopper 115 of the lower bracket portion 101, thereby disposing the side surfaces of both the upper bracket portion 201 and lower bracket portion 101 flush with one another. When the upper bracket portion 201 and lower bracket portion 101 are assembled, the upper bracket portion 201 may rotate about the axis of rotation 401. The axis of rotation 401 is defined by the intersection of the planes of the lower bracket portion 101 and the upper bracket portion 201.

Figure 6:
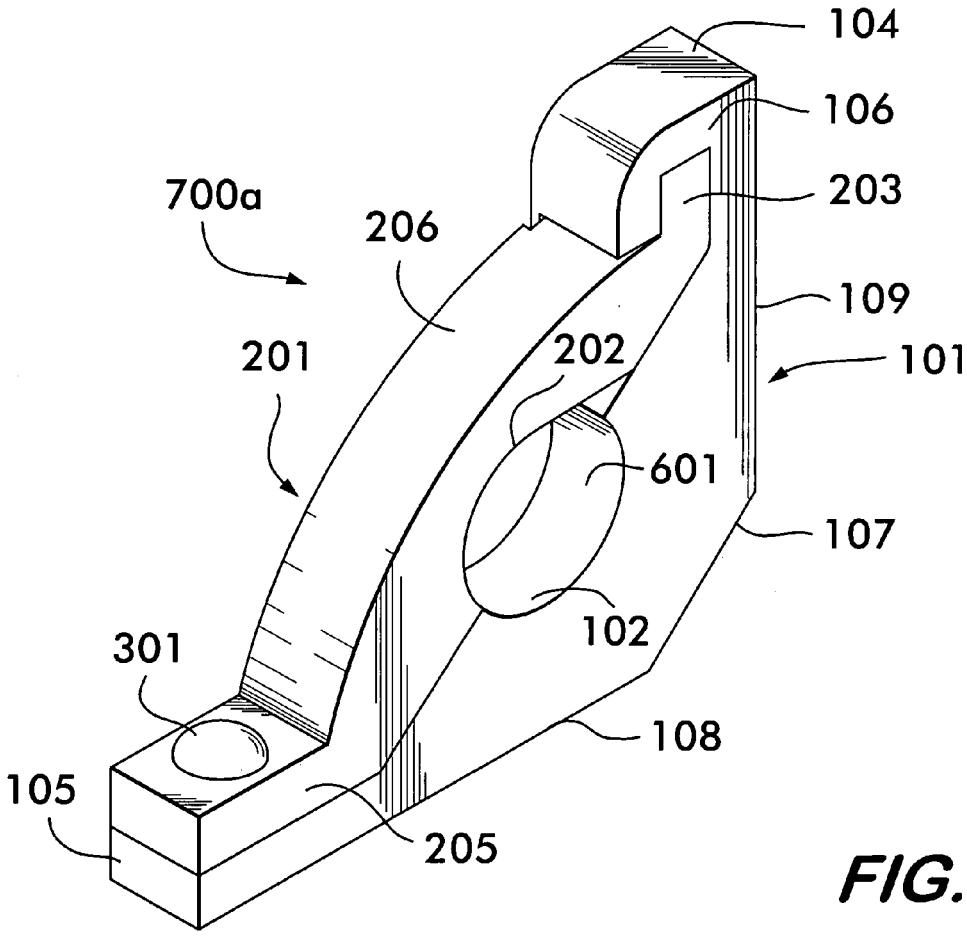
FIG. 6 is a perspective view of the stair rod bracket of FIG. 1 in a closed position without a stair rod inserted therein, thus exposing the rod receiving hole of the bracket.

FIG. 6 is a perspective view of the stair rod bracket 700*a* in its closed position, without the stair rod 501 inserted therein. The receiving hole 601 of the stair rod bracket 700*a*, which is defined by the upper portion semicircle 202 and the lower portion semicircle 102, is the opening into which the stair rod 501 is inserted. The lower bracket portion chamfer 107 does not come into direct contact with the surface of a stair step 114 when the lower bracket portion 101 is fastened to the stair step 114.

Figure 7:
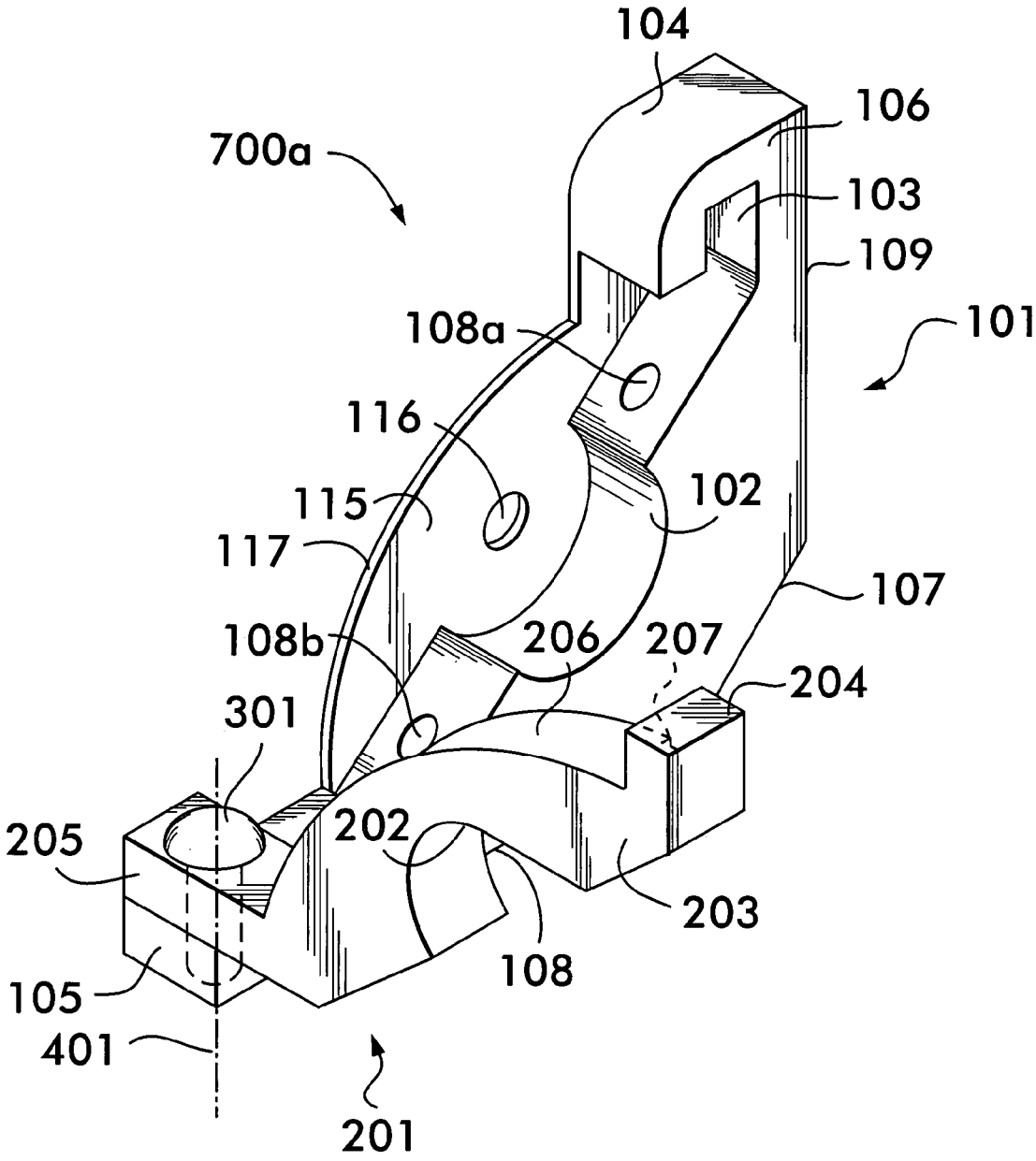
FIG. 7 is a perspective view of the stair rod bracket of FIG. 1 in an opened position.

FIG. 7 is a perspective view of the stair rod bracket 700*a* in an opened position. In this position, the locking projection 203, which is located at the uppermost section of the upper bracket portion 201, is spaced apart from the projection receiver 103, which is located at the uppermost section of the lower bracket portion 101. When a bracket 700*a,b* is closed as shown in FIGS. 3 and 6, the locking projection 203 is surroundingly received and retained by the projection receiver 103. In one preferred embodiment, the locking projection 203 is somewhat tightly received by the projection receiver 103.

Visible also from the open position displayed in FIG. 7 are the fastening holes 108*a,b* through the lower bracket portion 101. The purpose of the fastening holes 108*a,b* is to permit the lower bracket portion 101 to be affixed to a stair step 114 by means of screws or any other fasteners known in the art. Also visible in the open position of the bracket 700*a* is the rod stopper 115. The rod stopper 115 serves as a barrier to prevent the stair rod 501 from shifting in a lateral direction when it is disposed in the receiving hole 601. The upper surface 117 of the rod stopper 115 can make contact with the underside of the lip 207 of the upper bracket portion 201 when a bracket 700*a,b* is in a closed position. Also visible in the open position of the bracket 700*a* is the finial hole 116, into which a finial (not shown) may be inserted.

In order for the bracket to rotatably travel from a closed position, such as the position displayed in FIG. 6, to an opened position, as displayed in FIG. 7, and back again, the upper bracket portion 201 rotates about the axis of rotation 401. The upper bracket portion 201 can be manually rotated with respect to the lower bracket portion 101. In one preferred embodiment of the invention some rotational resistance can be provided in order to ensure that the does not open inadvertently without the need for any releasably securing means. The rotation resistance can be provided, for example, by a friction fit or pressure fit between the bottom surface of the lower section 205 of the upper bracket portion 201 and the opposing upper surface of the lower section 105 of the lower bracket portion 101, located in the vicinity of the press fit hinge screw 301. The pressure between the opposing surfaces of the bracket portions 101, 201 can be maintained, for example, by means of the press fit hinge screw 301. In order to further ensure that a bracket 700*a,b* does not open inadvertently without the need for any releasably securing means, other tight fits can be provided within the bracket 700*a,b*, for example between the mating locking projection 203 and projection receiver 103 when the bracket 700*a,b* is in its closed position.

In order to assemble a stair rod set 702, a stair rod 501 and two stair rod brackets 700*a,b* are required. The brackets 700*a,b* are mirror images of each other, so that with regard to the left bracket 700*a*, the upper bracket portion 201 rotates to the right in order to open the bracket, while with regard to the right bracket 700*b*, the upper bracket portion 201 rotates to the left to open the bracket. The brackets 700*a,b* are placed in opposing positions, with each respective upper bracket portion 201 opening in the direction of the oppositely placed bracket 700*a,b*. When the brackets 700*a,b* are disposed in their opened positions, as displayed in FIG. 7, the stair rod 501 can be seated in the lower portion semicircles 102 of the lower bracket portions 101. Once the stair rod 501 is seated as specified, the upper bracket portions 201 are rotated until the brackets 700*a,b* are in their fully closed positions, with the stair rod 501 firmly maintained within the receiving holes 601 of the brackets 700*a,b*. In one preferred embodiment of the invention the tolerances of the radii of the stair rod 501 and the receiving holes 601 can be selected to maintain a tight fit between the stair rod 501 and the receiving holes 601. Such a design feature would be an added assurance that the stair rod 501 remains firmly seated in the bracket 700.

Without further elaboration, the foregoing will so fully illustrate my invention that others may, by applying current or future knowledge, adopt the same for use under various conditions of service.

The invention claimed is:

1. A bracket system for retaining a stair rod, comprising:

first and second stair rod brackets for disposing said first and second stair rod brackets on a stair and defining an area between said first and second stair rod brackets;

each of said first and second stair rod brackets having a respective first bracket portion defining a respective first bracket plane for affixing said first bracket portions to said stair;

each of said first and second stair rod brackets having a respective second bracket portion rotatably coupled to its first bracket portion for relative rotation of said first and second bracket portions between a bracket open position when rotating said second bracket portions toward said defined area and a bracket closed position when rotating said second bracket portions away from said defined area wherein said relative rotation includes only horizontal rotation of said second bracket portion; and each of said second bracket portions defining a respective second bracket plane wherein said first and second bracket planes of each of said first and second stair rod brackets are coplanar only when said first and second stair rod brackets are in said bracket closed position.

2. The bracket of claim 1, wherein said first and second stair rod brackets maintain said bracket closed position independently of any releasably securing means.

3. The bracket of claim 1, wherein friction between surfaces of said first bracket portions and surfaces of said second bracket portions provides a friction fit between said first and second bracket portions and maintains said first and second stair rod brackets in said bracket closed position.

4. The bracket of claim 3, further comprising an axis defined by an intersection of said first and second bracket planes wherein said friction fit is provided by friction between said surfaces of said first and second bracket portions in the vicinity of said axis.

5. The bracket of claim 4, further comprising a press fit hinge in the vicinity of said axis.

6. The bracket of claim 1, further comprising a bracket mating region including a mating projection disposed on one of said first and second bracket portions and a mating projection receiving region disposed on the other of said first and second bracket portions for matably receiving said mating projection within said mating projection receiving region during said rotation to said bracket closed position.

7. The bracket of claim 1, further comprising a stair rod receiving region defined by said first and second bracket portions when said bracket is in said bracket closed position for receiving and securing said stair rod therein.

8. The bracket of claim 1, further comprising a bracket angle between said first and second bracket planes wherein said bracket angle increases in magnitude as said second bracket portions rotate from said bracket closed position to said bracket open position.

9. A bracket system for retaining a stair rod to secure a carpet to a staircase, comprising:

first and second stair rod brackets defining an area between said first and second stair rod brackets, each stair rod bracket having;

a first bracket portion for affixing said first bracket portion to a stair;

a second bracket portion rotatably coupled to said first bracket portion for relative rotation only in a horizontal direction; and a bracket mating region including a mating projection disposed on one of said first and second bracket portions and a mating projection receiving region disposed on the other of said first and second bracket portions for matably receiving said mating projection when said bracket is rotated away from said defined area to a bracket closed position and surroundingly retaining said mating projection within said mating projection receiving region.

10. The bracket of claim 9, wherein said first and second stair rod brackets maintain said bracket closed position independently of any releasably securing means.

11. The bracket of claim 9, wherein friction between a surface of said first bracket portion and a surface of said second bracket portion provides a friction fit between said first and second bracket portions and maintains said first and second stair rod brackets in said bracket closed position.

12. The bracket of claim 11, further comprising an axis defined by an intersection of said first and second bracket planes wherein said friction fit is provided by friction between said surfaces of said first and second bracket portions in the vicinity of said axis.

13. The bracket of claim 12, further comprising a press fit hinge in the vicinity of said axis.

14. The bracket of claim 9, wherein friction between surfaces of said mating projection and said mating projection receiving region provides a friction fit between said first and second bracket portions for maintaining said first and second stair rod brackets in said bracket closed position.

15. The bracket of claim 9, further comprising a stair rod receiving region defined by said first and second bracket portions when said first and second stair rod brackets are in said bracket closed position for receiving and securing said stair rod therein.

16. The bracket of claim 9, further comprising a bracket angle between said first and second bracket planes wherein said bracket angle increases in magnitude as said second bracket portion rotates from said bracket closed position to a bracket open position.

* * * * *